US008789808B1

(12) United States Patent
Moley

(10) Patent No.: US 8,789,808 B1
(45) Date of Patent: Jul. 29, 2014

(54) URINAL WITH OPERATION CONTROLLED VIA A REPLICA OF A MOTORCYCLE HANDLEBAR

(71) Applicant: Anthony J. Moley, Hollister, CA (US)

(72) Inventor: Anthony J. Moley, Hollister, CA (US)

( * ) Notice: Subject to any disclaimer, the term of this patent is extended or adjusted under 35 U.S.C. 154(b) by 0 days.

(21) Appl. No.: 13/785,144

(22) Filed: Mar. 5, 2013

(51) Int. Cl.
*F16K 31/00* (2006.01)
*E03D 5/09* (2006.01)

(52) U.S. Cl.
CPC ..... *E03D 5/09* (2013.01)
USPC ..... 251/294; 251/15; 4/301; 4/313; 4/411; 4/661

(58) Field of Classification Search
USPC ..... 251/15, 22, 129.01, 129.04, 294, 369; 4/301, 313, 411, 661
See application file for complete search history.

(56) References Cited

U.S. PATENT DOCUMENTS

| | | | | | |
|---|---|---|---|---|---|
| 2,633,141 | A | * | 3/1953 | Russell | 137/49 |
| 3,594,828 | A | * | 7/1971 | Seek | 251/294 |
| 4,019,402 | A | | 4/1977 | Leonheart | |
| D274,122 | S | | 6/1984 | Stahel | |
| 4,531,751 | A | | 7/1985 | Todokoro | |
| 4,611,356 | A | | 9/1986 | Lin | |
| 4,932,913 | A | | 6/1990 | Raviv | |
| D315,132 | S | | 3/1991 | Lance | |
| 5,482,078 | A | * | 1/1996 | Yeh | 137/551 |
| 5,499,008 | A | * | 3/1996 | Rosenkrantz et al. | 340/384.7 |
| 5,505,493 | A | | 4/1996 | Brashear | |
| D372,893 | S | | 8/1996 | Harris | |
| 5,652,975 | A | * | 8/1997 | Hoskin | 4/661 |
| 5,809,590 | A | * | 9/1998 | Williams et al. | 4/661 |
| 5,836,021 | A | * | 11/1998 | Davidson et al. | 4/411 |
| 5,870,015 | A | * | 2/1999 | Hinkel | 340/573.1 |
| 5,978,975 | A | * | 11/1999 | Asskaryar | 4/353 |
| 6,234,800 | B1 | | 5/2001 | Koyama | |
| 6,385,796 | B1 | * | 5/2002 | Muir, Jr. | 4/661 |
| 6,894,270 | B2 | * | 5/2005 | Bailey | 250/221 |
| 7,043,774 | B2 | * | 5/2006 | Picchi | 4/420 |
| 7,611,073 | B2 | * | 11/2009 | Crutcher | 239/25 |
| 7,805,869 | B1 | * | 10/2010 | Pascarelli et al. | 40/539 |
| D635,219 | S | | 3/2011 | Funari | |
| 8,424,126 | B2 | * | 4/2013 | Nguyen | 4/362 |
| 8,556,228 | B2 | * | 10/2013 | Marcichow et al. | 251/129.04 |
| 2006/0143822 | A1 | * | 7/2006 | Kelley | 4/661 |
| 2008/0196159 | A1 | * | 8/2008 | Lee | 4/678 |
| 2010/0066928 | A1 | * | 3/2010 | Pelfrey | 349/16 |

* cited by examiner

*Primary Examiner* — John K Fristoe, Jr.
*Assistant Examiner* — Matthew W Jellett
(74) *Attorney, Agent, or Firm* — Kyle A. Fletcher, Esq.

(57) ABSTRACT

The urinal with operation controlled via a replica of a motorcycle handlebar is a wall-mounted fixture configured to control the use of the flush valve of said urinal, or toilet, or other plumbing fixture. The replica motorcycle handlebar includes a linkage that runs from the throttle portion of the motorcycle handlebar to the flush valve of said urinal such that upon simulation of a throttling gesture shall pull said flush valve upwardly in order to flush the respective urinal or plumbing fixture. The replica motorcycle handlebar includes a motion sensor that upon detection of a person shall communicate an audio recording of a motorcycle noise. The replica motorcycle handlebar includes mirrors, turn signals, and a horn switch. Throttling motion of the throttle portion may also prompt an additional audio recording of a motorcycle engine being revved.

8 Claims, 5 Drawing Sheets

URINAL WITH OPERATION CONTROLLED VIA A REPLICA OF A MOTORCYCLE HANDLEBAR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of urinals, more specifically, a replica motorcycle handlebar that operates the plumbing and flush portion of said urinal.

B. Discussion of the Prior Art

As will be discussed immediately below, no prior art discloses a replica motorcycle handlebar that is able to be mounted on a wall surface and configured to operate a flush valve of a urinal via a linkage that runs from the throttle portion of the motorcycle handlebar to the flush valve of said urinal; wherein the replica motorcycle handlebar includes a motion sensor that upon detection of a person shall communicate an audio recording of a motorcycle noise; wherein the replica motorcycle handlebar includes mirrors, turn signals, and a horn switch; upon throttling the throttle portion of the replica motorcycle handlebar, the linkage shall flush the urinal, and may additionally play an audio recording of the motorcycle engine being revved; wherein the replica motorcycle handlebar is either integrated into the design of a urinal or is an after-market product configured for use with an existing urinal, toilet, sink, or other plumbing fixture.

The Todokoro patent (U.S. Pat. No. 4,531,751) discloses a toy motorcycle with simulated lights, sounds, and gauges. However, the toy motorcycle does not fit above a urinal and control operation or flushing of said urinal via a replica of a motorcycle handlebar.

The Raviv et al. patent (U.S. Pat. No. 4,932,913) discloses a hand held control device for use by a child to simulate the directional and speed control of a vehicles such as a motorcycle. However, the device does not control the flush of a plumbing fixture, and resemble a replica of a motorcycle handlebar.

The Camfield et al. patent (U.S. Pat. No. 5,505,493) discloses a bicycle with simulated motorcycle parts and has a sound system included that replicates the sound of a motorcycle. However, the bicycle is not configured for use with a plumbing fixture, and upon throttling of a replicate motorcycle handlebar shall control the flush or water valve operation of said plumbing fixture.

The Leonheart patent (U.S. Pat. No. 4,019,402) discloses a motorcycle throttle, twist-grip control unit. Again, the throttle does not control operation of a plumbing fixture, such as a urinal or toilet.

The Stahel et al. patent (U.S. Pat. No. Des. 274,122) illustrates an ornamental design for a motorcycle handlebar grip, which is not a replica for use in operating the flush valve of a urinal or toilet.

The Lance patent (U.S. Pat. No. Des. 315,132) illustrates an ornamental design for a motorcycle handlebar, which does not operate a flush valve of a urinal or toilet.

The Harris patent (U.S. Pat. No. Des. 372,993) illustrates an ornamental design for a motorcycle handlebar, which does not operate a flush valve of a urinal or toilet.

The Lin patent (U.S. Pat. No. 4,611,356) discloses a flushing apparatus for urinals. However, the flushing apparatus does not resemble a replica of a motorcycle handlebar.

While the above-described devices fulfill their respective and particular objects and requirements, they do not describe a replica motorcycle handlebar that is able to be mounted on a wall surface and configured to operate a flush valve of a urinal via a linkage that runs from the throttle portion of the motorcycle handlebar to the flush valve of said urinal; wherein the replica motorcycle handlebar includes a motion sensor that upon detection of a person shall communicate an audio recording of a motorcycle noise; wherein the replica motorcycle handlebar includes mirrors, turn signals, and a horn switch; upon throttling the throttle portion of the replica motorcycle handlebar, the linkage shall flush the urinal, and may additionally play an audio recording of the motorcycle engine being revved; wherein the replica motorcycle handlebar is either integrated into the design of a urinal or is an after-market product configured for use with an existing urinal, toilet, sink, or other plumbing fixture. In this regard, the urinal with operation controlled via a replica of a motorcycle handlebar departs from the conventional concepts and designs of the prior art.

SUMMARY OF THE INVENTION

The urinal with operation controlled via a replica of a motorcycle handlebar is a wall-mounted fixture configured to control the use of the flush valve of said urinal, or toilet, or other plumbing fixture. The replica motorcycle handlebar includes a linkage that runs from the throttle portion of the motorcycle handlebar to the flush valve of said urinal such that upon simulation of a throttling gesture shall pull said flush valve upwardly in order to flush the respective urinal or plumbing fixture. The replica motorcycle handlebar includes a motion sensor that upon detection of a person shall communicate an audio recording of a motorcycle noise. The replica motorcycle handlebar includes mirrors, turn signals, and a horn switch. Throttling motion of the throttle portion may also prompt an additional audio recording of a motorcycle engine being revved. The replica motorcycle handlebar is either integrated into the design of a urinal or is an after-market product configured for use with an existing urinal, toilet, sink, or other plumbing fixture.

It is an object of the invention to provide a fixture that is mounted above or adjacent a plumbing fixture, and which resembles a motorcycle handlebar, and upon throttling action of a throttle portion shall move or otherwise operate a flush valve of said plumbing fixture.

A further object of the invention to provide a replica motorcycle handlebar that is configured to be mounted on a wall surface either above or adjacent the plumbing fixture, and which requires simple retrofitting of the flush valve in order to enable the throttle portion to rotate in order to flush the respective plumbing fixture.

A further object of the invention is to provide a speaker and central processing unit that include pre-recorded audio files of motorcycle engine noises so as to add to the overall experience associated with use of the motorcycle handlebars when in use.

Another object of the invention is to include a motion sensor that detects the presence of a person, and upon said detection shall prompt playing of an audio file via the speaker.

Another object of the invention is to include mirrors, working blinkers, and horn on the replica motorcycle handlebar.

These together with additional objects, features and advantages of the urinal with operation controlled via a replica of a motorcycle handlebar will be readily apparent to those of ordinary skill in the art upon reading the following detailed description of presently preferred, but nonetheless illustrative, embodiments of the urinal with operation controlled via a replica of a motorcycle handlebar when taken in conjunction with the accompanying drawings.

In this respect, before explaining the current embodiments of the urinal with operation controlled via a replica of a motorcycle handlebar in detail, it is to be understood that the urinal with operation controlled via a replica of a motorcycle handlebar is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the urinal with operation controlled via a replica of a motorcycle handlebar.

It is therefore important that the claims be regarded as including such equivalent construction insofar as they do not depart from the spirit and scope of the urinal with operation controlled via a replica of a motorcycle handlebar. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
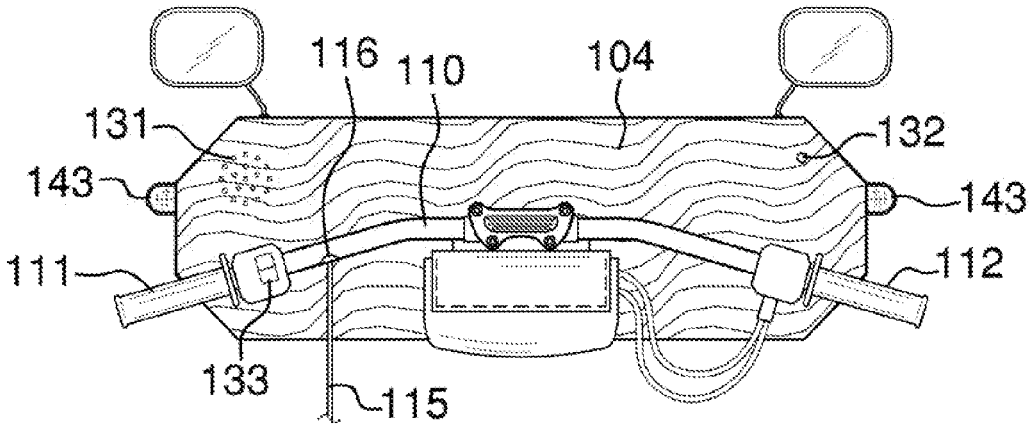
FIG. 1 illustrates a front view of the replica motorcycle handlebar by itself.
Figure 2:
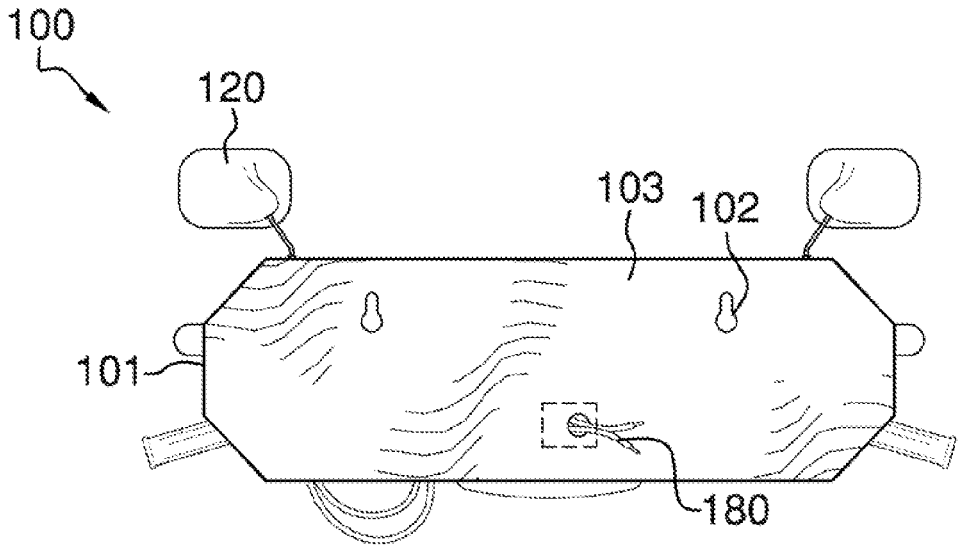
FIG. 2 illustrates a rear view of the replica of a motorcycle handlebar, and detailing the mounting member.
Figure 3:
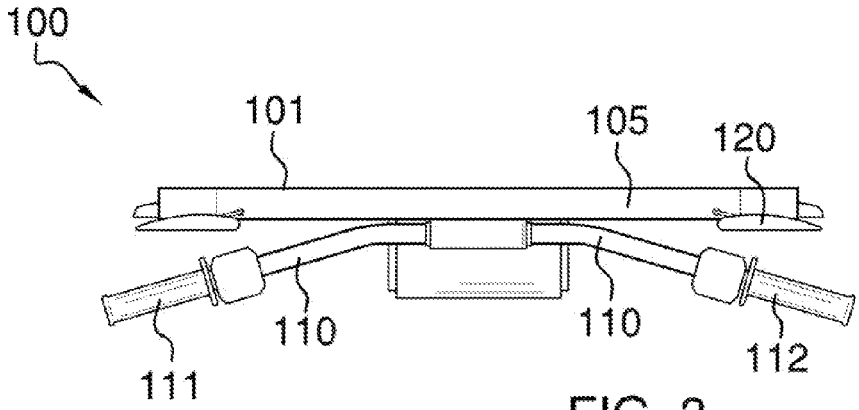
FIG. 3 illustrates a top view of the replica motorcycle handlebar.
Figure 4:
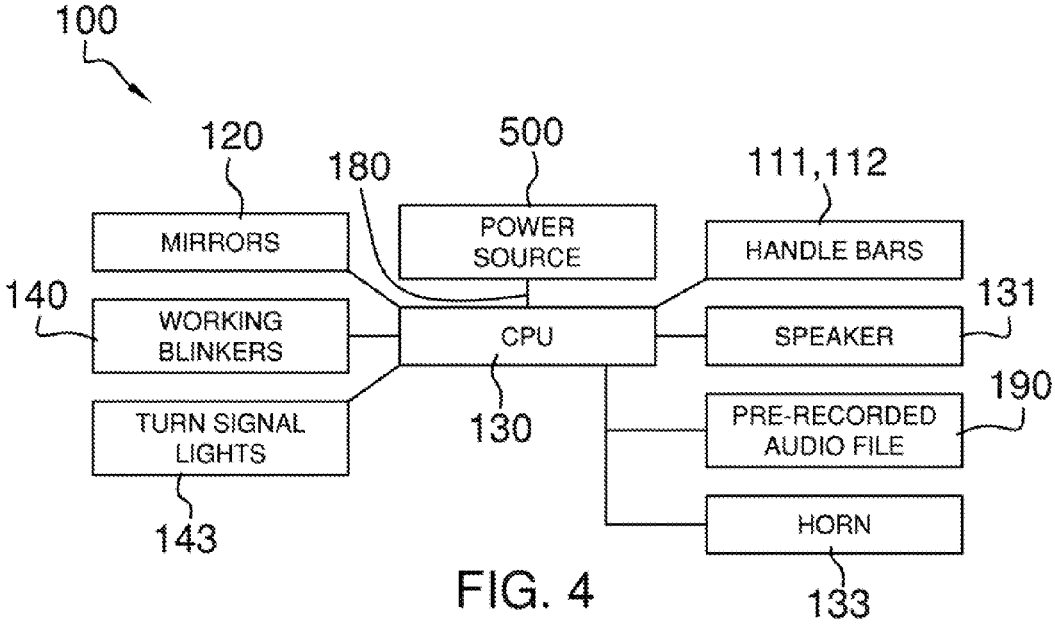
FIG. 4 illustrates a diagram of the components associated with operation of the replica motorcycle handlebar.
Figure 5:
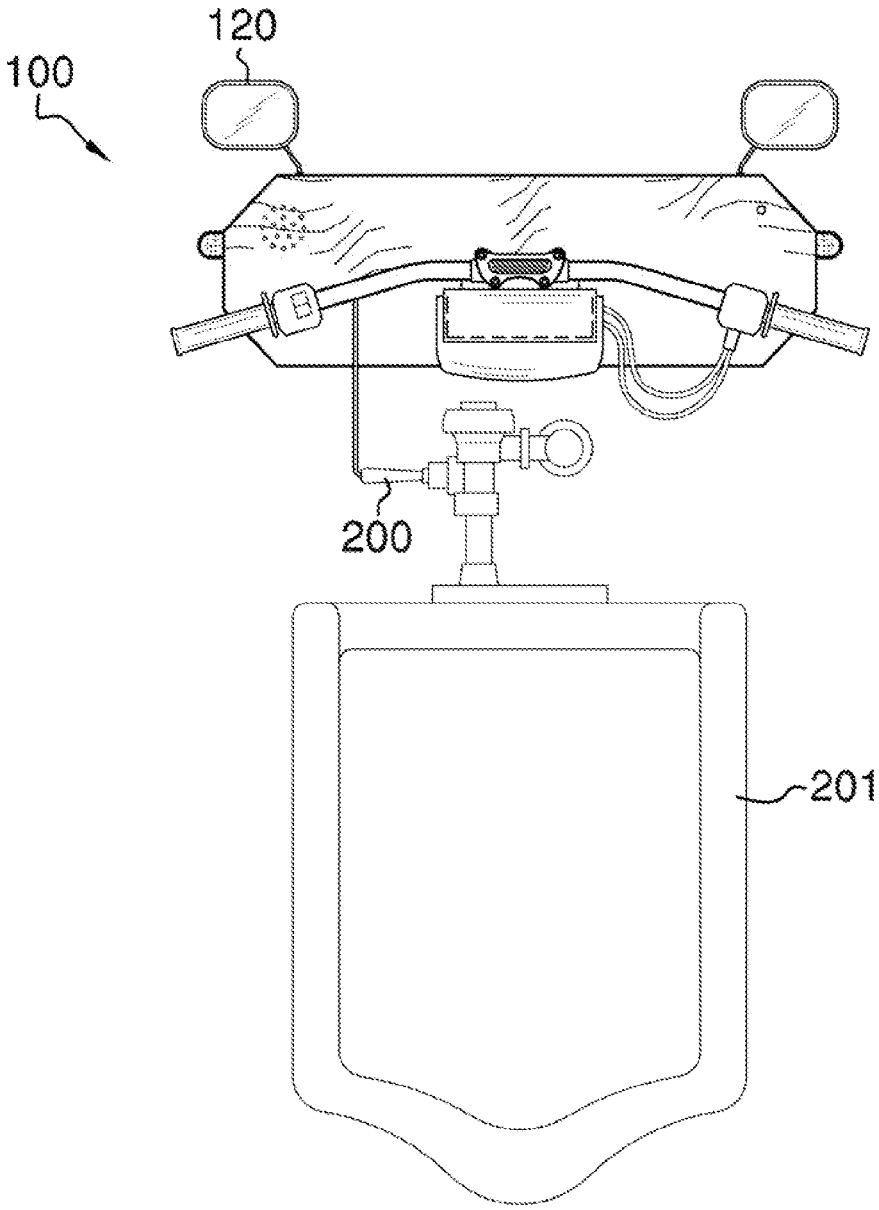
FIG. 5 illustrates a front view of the replica motorcycle handlebar in use with a urinal.
Figure 6:
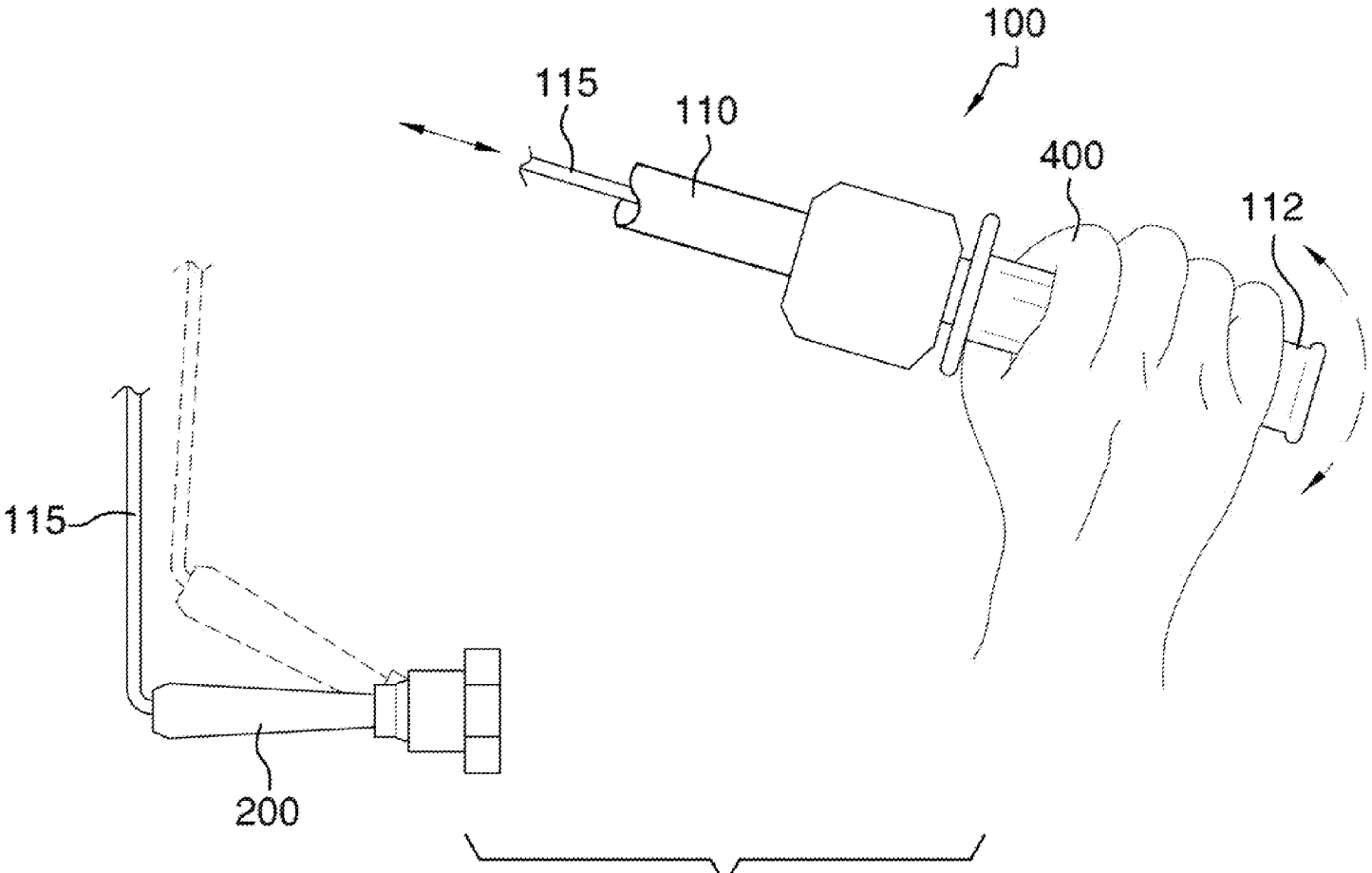
FIG. 6 illustrates a detailed view of the throttle portion being manually rotated, and a corresponding movement of the flush valve of the urinal.
Figure 7:
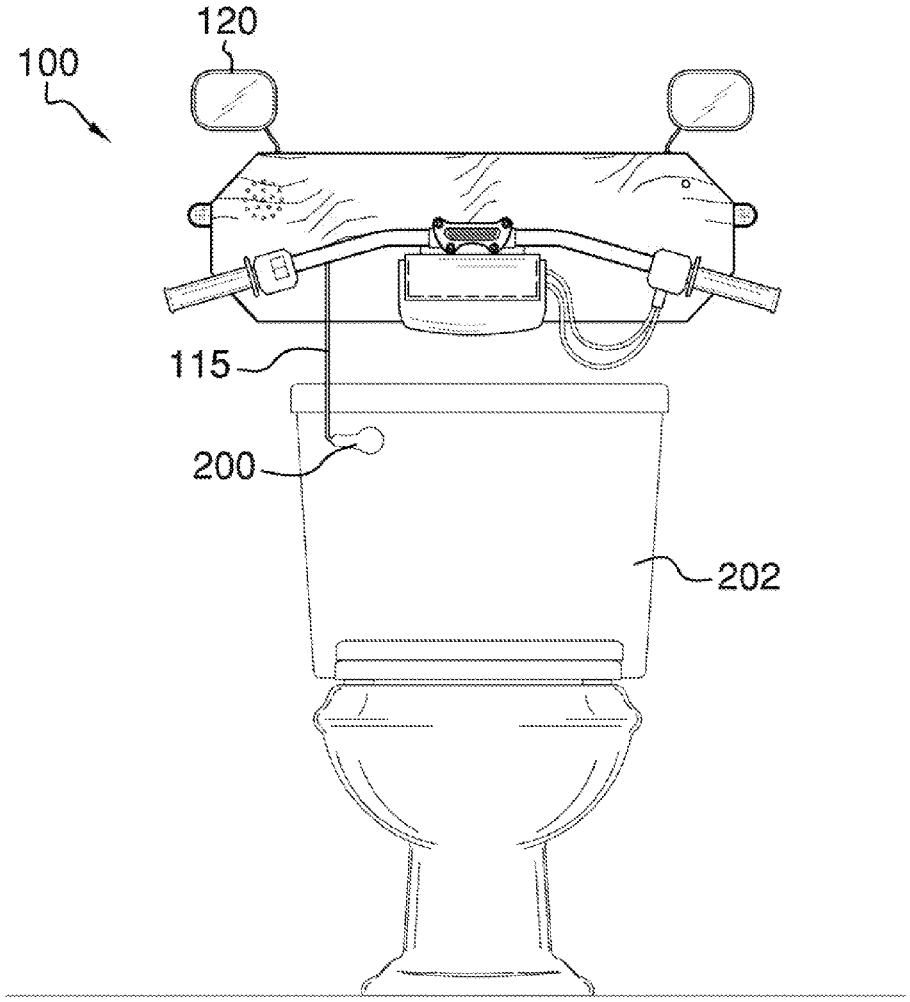
FIG. 7 illustrates a view of the replica motorcycle handlebar installed above a toilet, and depicting connection with the flush valve of the toilet.

Detailed reference will now be made to the preferred embodiment of the present invention, examples of which are illustrated in FIGS. 1-5. A urinal with operation controlled via a replica of a motorcycle handlebar 100 (hereinafter invention) includes a mounting member 101 that includes mount holes 102 along a rear surface 103 such that the invention 100 is configured to be mounted onto a wall or flat surface.

The mounting member 101 is further defined with a front surface 104 upon which a replica motorcycle handlebar 110 is affixed thereon. The replica motorcycle handlebar 110 includes a first handle 111 and a second handle 112. It shall be noted that the term first handle 111 and the second handle 112 may be referred to as handlebars, which is indicated as such in FIG. 4. The second handle 112 is rotatably engaged with respect to the replica motorcycle handlebar 110, and shall also be referred to as the throttle portion of the invention 100. The second handle 112 rotates with respect to the replica motorcycle handlebar 110, and internally moves a linkage 115 that runs inside of the replica motorcycle handlebar 110.

It shall be noted that the replica motorcycle handlebar 110 is constructed of a hollow pipe, and which enables the linkage 115 to run from the second handle 112 to an outlet 116 located elsewhere on the replica motorcycle handlebar 110. The linkage 115 is of an undefined length, and connects to a flush valve 200. It shall be noted that the flush valve 200 may be of a urinal 201 or a toilet 202. The main function of the invention 100 is to flush the urinal 201 or toilet 202 upon rotation of the second handle 112 and in a manner consistent with throttling a motorcycle.

It shall be further noted that plumbing fixture is being used to refer to the urinal 201 or the toilet 202, or other type of plumbing fixture or appliance that may require flushing. The plumbing fixture may involve a faucet or water valve for a sink, bathtub, or shower.

The invention 100 includes mirrors 120 that are mounted on a top surface 105 of the mounting member 101. The mirrors 120 resemble the size and shape and location that are customary of a motorcycle, and adds to the overall effect that the invention 100 resembles that of a motorcycle.

The invention 100 includes a central processing unit 130 that is in wired communication with a speaker 131, which is located elsewhere with respect to the invention 100. The central processing unit 130 is also in wired communication with a motion sensor 132 that is able to detect the presence of an end user 400, and upon doing so shall play a pre-recorded audio file 190 via the central processing unit 130 and the speaker 131. The invention 100 may further include a horn button 133 that when depressed shall sound a pre-recorded audio file of a motorcycle horn. The horn button 133 may be located on the replica motorcycle handlebar 110, and more specifically, adjacent to either the first handle 111 or the second handle 112.

The central processing unit 130 shall include wiring 180 that exits the rear surface 103 of the mounting member 101, and extends to a power source 500.

It shall be noted that the invention 100 may be mounted directly above or aside of the plumbing fixture. The figures depict the invention 100 as being mounted on the wall surface just above the urinal 201 and the toilet 202. The location of the invention 100 would ideally be attributed with ease of accessing the second handle 112 with respect to the plumbing fixture.

The invention 100 may include turn blinkers 140 that may involve the use of a turn signal switch 141 located on either or both of the first handle 111 and the second handle 112. The turn signal switch 141 when operated shall make a noise associated with a turn blinker, and may operate turn signal lights 143.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A replica motorcycle handlebar comprising:

the replica motorcycle handlebar is configured for use with a plumbing fixture, and is further defined with a first handle and second handle;

wherein the second handle is able to rotate about a longitudinal axis, and is in mechanical connection with a linkage that spans to a flush valve of said plumbing fixture wherein a mounting member includes mount holes along a rear surface, and is configured to be mounted onto a wall or flat surface adjacent to or above said plumbing fixture; said mounting member is further defined with a front surface upon which the replica motorcycle handlebar is affixed thereon; the replica motorcycle handlebar is constructed of a hollow pipe, and which enables the linkage to run from the second handle to an outlet located elsewhere on the replica motorcycle handlebar, wherein the linkage is of an undefined length, and connects to the flush valve; wherein mirrors are attached to and extend upwardly from a top surface of the mounting member; wherein a central processing unit is in wired communication with a speaker, which plays a pre-recorded audio file of a motorcycle engine; the central processing unit is also in wired communication with a motion sensor that is able to detect the presence of an end user, and upon doing so shall lay the pre-recorded audio file via the central processing unit and the speaker; wherein a horn button that when depressed shall sound a pre-recorded audio file of a motorcycle horn; wherein the horn button is in wired communication with the central processing unit.

2. The replica motorcycle handlebar as described in claim 1 wherein the horn button is located on the replica motorcycle handlebar, and more specifically, adjacent to either the first handle or the second handle.

3. The replica motorcycle handlebar as described in claim 2 wherein the central processing unit includes wiring that exits the rear surface of the mounting member, and extends to a power source.

4. The replica motorcycle handlebar as described in claim 3 wherein turn blinkers involve the use of a turn signal switch located on either or both of the first handle and the second handle; wherein the turn signal is in wired communication with the central processing unit; wherein the turn signal switch when operated shall make a noise associated with a turn blinker, and operate turn signal lights.

5. A replica motorcycle handlebar comprising:

the replica motorcycle handlebar is configured for use with a plumbing fixture, and is further defined with a first handle and second handle;

wherein said plumbing fixture comprises a urinal or toilet;

wherein the second handle is able to rotate about a longitudinal axis, and is in mechanical connection with a linkage that spans to a flush valve of said plumbing fixture;

wherein a mounting member includes mount holes along a rear surface, and is configured to be mounted onto a wall or flat surface adjacent to or above said plumbing fixture wherein said mounting member is further defined with a front surface upon which the replica motorcycle handlebar is affixed thereon; the replica motorcycle handlebar is constructed of a hollow pipe, and which enables the linkage to run from the second handle to an outlet located elsewhere on the replica motorcycle handlebar, wherein the linkage is of an undefined length, and connects to the flush valve; wherein mirrors are attached to and extend upwardly from a top surface of the mounting member, wherein a central processing unit is in wired communication with a speaker, which plays a pre-recorded audio file of a motorcycle engine; the central processing unit is also in wired communication with a motion sensor that is able to detect the presence of an end user, and upon doing so shall lay the pre-recorded audio file via the central processing unit and the speaker, wherein a horn button that when depressed shall sound a pre-recorded audio file of a motorcycle horn; wherein the horn button is in wired communication with the central processing unit.

6. The replica motorcycle handlebar as described in claim 5 wherein the horn button is located on the replica motorcycle handlebar, and more specifically, adjacent to either the first handle or the second handle.

7. The replica motorcycle handlebar as described in claim 6 wherein the central processing unit includes wiring that exits the rear surface of the mounting member, and extends to a power source.

8. The replica motorcycle handlebar as described in claim 7 wherein turn blinkers involve the use of a turn signal switch located on either or both of the first handle and the second handle; wherein the turn signal is in wired communication with the central processing unit; wherein the turn signal switch when operated shall make a noise associated with a turn blinker, and operate turn signal lights.

* * * * *